United States Patent [19]

Hallenbeck et al.

[11] Patent Number: 4,637,564

[45] Date of Patent: Jan. 20, 1987

[54] DUAL REEL CONTINUOUS WIRE WINDING MACHINE WITH ROBOTIC REEL LOADING MECHANISM

[75] Inventors: Mark Hallenbeck, Buffalo Grove; Robert H. Frankenbush, Highland Park, both of Ill.

[73] Assignee: FTS Equipment Manufacturing Co., Skokie, Ill.

[21] Appl. No.: 794,565

[22] Filed: Nov. 4, 1985

[51] Int. Cl.[4] ..... B65H 54/02; B65H 67/052

[52] U.S. Cl. ..... 242/25 A; 242/35.5 A; 242/79

[58] Field of Search ..... 242/25 A, 18 A, 35.5 A, 242/25 R, 79

[56] References Cited

U.S. PATENT DOCUMENTS

| | | | |
|---|---|---|---|
| 2,961,175 | 11/1960 | Detrick et al. | 242/25 A |
| 2,961,177 | 11/1960 | Swanson | 242/25 A |
| 3,621,190 | 11/1971 | Morikawa et al. | 242/24 A X |
| 3,698,652 | 10/1972 | Morikawa et al. | 242/25 A |
| 3,831,871 | 8/1974 | Ikegami et al. | 242/25 A X |
| 3,837,589 | 9/1974 | Johnson et al. | 242/25 A |
| 3,858,817 | 1/1975 | Riekkinen | 242/25 A |
| 3,877,653 | 4/1975 | Foltyn et al. | 242/25 A |
| 3,964,723 | 6/1976 | Schippers et al. | 242/35.5 A |
| 3,971,519 | 7/1976 | Ikegami et al. | 242/25 A |
| 4,007,882 | 2/1977 | Isoard | 242/35.5 A X |
| 4,015,785 | 4/1977 | Ikegami et al. | 242/25 A |
| 4,023,743 | 5/1977 | Schippers | 242/35.5 A |
| 4,044,959 | 8/1977 | Lemaire | 242/25 A |
| 4,438,886 | 3/1984 | Meisser et al. | 242/25 A |
| 4,555,067 | 11/1985 | Angelucci et al. | 242/35.5 A |
| 4,591,106 | 5/1986 | Gay | 242/35.5 A X |

*Primary Examiner*—Stanley N. Gilreath

*Attorney, Agent, or Firm*—Dressler, Goldsmith, Shore, Sutker & Milnamow, Ltd.

[57] ABSTRACT

A continuous wire winding machine for winding wire on reels having a pair of spaced flanges connected by a central core. The machine includes a machine frame, a conveyor for supplying empty reels to and removing wound reels from the machine, two pairs of arbor means for gripping and rapidly rotating reels for the winding of wire thereon, one of each of said pairs being a driven arbor, and transfer mechanism for transferring empty reels from the conveyor and wound reels to the conveyor. The transfer mechanism includes a pair of robotic arm assemblies, each of which comprises a first gripper for grasping an empty reel at one end of the assembly and a second gripper for grabbing a wound reel at the other end of the assembly, shaft means mounting each of the robotic arm assemblies for oscillation through an arc of 180°, means for oscillating the shaft, and driving means for mounting the grippers for moving them between an outwardly extended position and an inwardly retracted position relative to the assembly and the shaft, whereby when the grippers are in their extended positions, they are enabled alternatively to present an empty reel between a pair of said arbors and to grab a wound reel positioned between said pair of arbors, and when said grippers are in their retracted positions, the assembly is enabled to be oscillated about the axis of said shaft. Improved traversing means and diverting means, cutters and blockers and snaggers are also provided.

26 Claims, 22 Drawing Figures

DUAL REEL CONTINUOUS WIRE WINDING MACHINE WITH ROBOTIC REEL LOADING MECHANISM

BACKGROUND OF THE INVENTION

This invention relates to a wire winding machine, and to substantial improvements therein.

The prior art is replete with a variety of wire winding machines. In many such machines, wire is wound on a reel which is supplied to the machine and which is then discharged from the machine when wound. Such machines frequently provide a pair of winders so that when one reel is fully wound, the wire may be cut and transferred to an adjacent empty reel for winding, following which the wound reel is then discharged, a new empty reel is supplied, and the cycle is repeated.

Such machines usually operate at high speeds. The mechanisms are therefore subject to stresses and wear. Too frequently they malfunction, slowing the effective winding rate of the machine.

In typical prior art machines, empty reels are normally supplied by rolling them into the machine, elevating them on an elevator, grasping them between arbors, winding wire on them, then disengaging them, lowering them on an elevator, and rolling them out of the machine on a ramp. Imperfections in the reels create problems in such feeding and discharging of them. Elevator mechanisms can malfunction. Wire hang ups (failure to clear snaggers on the winding arbors) cause malfunctions as a wound roll remains snagged or otherwise hung up by associated wire in the machine.

It would be of advantage to avoid these and related problems, and the improved wire winding machine of this invention does that.

SUMMARY OF THE INVENTION

The invention of the present invention provides a dual-reel continuous wire winding machine which feeds reels thereto by, and discharges them therefrom on, a compartmented conveyor rather than by ramps and chutes. This facilitates transfer to the machine and discharge from the machine, and packaging of wound reels after discharge, all without causing a wound reel to unwind, as it tends to do when rolled down a chute to discharge it. The machine eliminates elevator mechanisms by providing dual-function robotic arms which both supply a fresh reel and withdraw a wound reel concurrently, positively positioning them where desired. The machine provides an improved snagger system which is self-clearing and which provides for reliable cut-over from a full reel to an empty reel. The machine further provides an improved traversing mechanism which eliminates the problems endemic in those which require moveable motors, cables, and electronic cable loops. Further, the cut-over mechanism is substantially simpler and is much more dependable than those of the prior art.

In accordance with the present invention there is provided a continuous wire winding machine for winding wire on reels having a pair of spaced flanges connected by a central core, the machine including, a machine frame, conveyor means for supplying empty reels to and removing wound reels from the machine, transfer means for transferring empty reels from the conveyor means and wound reels to the conveyor means, two pairs of arbor means for gripping and rapidly rotating reels for the winding of wire thereon, one of each of the pairs being a driven arbor, means for traversing running wire supplied from a wire supply along the length of the core of a reel to spread the wire evenly on the core, and means for diverting the wire from a wound reel to an empty reel and for cutting the wire to commence winding of an empty reel. Desirably, the transfer means comprises a pair of robotic arm assemblies, each assembly comprising a first gripper for grasping an empty reel at one end of the assembly and a second gripper for grabbing a wound reel at the other end of the assembly, shaft means mounting each said robotic arm assembly for oscillation of the assembly through an arc of 180°, and means for oscillating the shaft, and driving means mounting the grippers for moving them between an outwardly extended position and an inwardly retracted position relative to the assembly and the shaft, whereby when the grippers are in their extended positions, they are enabled to present an empty reel between a pair of the arbors and to grab a wound reel positioned between the pair of arbors, and when the grippers are in their retracted positions, the assembly is enabled to be oscillated about the axis of the shaft.

Preferably, each first gripper comprises hands and spring means for facilitating gripping the core of a reel, and each second gripper comprises powered grabbers for clampingly grasping a wire wound core, each for holding same for movement and for transfer and presentation to the arbor means and to the conveyor means, respectively. First locating and stop means for positioning the reels lengthwise relative to the conveyor means and further locating and stop means for positioning the arbor means relative to the reels may also be provided.

Desirably, the conveyor means comprises a continuous conveyor defining compartments for confining reels and for presenting empty reels to each of the transfer means and for receiving wound reels from the transfer means. Preferably, the conveyor is provided with upstanding transversely oriented paddles separating the conveyor into a series of longitudinally oriented compartments proportioned to receive reels.

Desirably, each arbor means has a snagger for snagging a leading end of the running wire to be wound on a reel, and each diverting means comprises a pair of blockers, each having associated cutters, one for each pair of arbor means, and a hook mounted for movement between an inactive position of rest and an active position of hooked engagement with the running wire, the hook and blockers being so positioned that when said hook moves toward and into said position of hooked engagement, it carries the running wire into engagement with a surface of the blocker for the wound reel and into the path of the snagger of the empty reel arbor, and said empty reel arbor snagger then draws the wire across the cutter of the empty reel arbor blocker to cut same. Preferably, each blocker defines a yoke with the cutter being disposed in line with the yoke, the blockers being positioned so that the blocker surface which the running wire engages restrains the running wire from entering the path of the wound reel snagger.

Desirably, each driven arbor includes a snagger means for snagging a leading end of the wire to be wound on an empty reel, the snagger means comprising an elongated mounting member and having a snagger adjacent one end thereof, the other end of said elongated mounting member comprising a counterweight, whereby, when the driven arbor is at rest, the snagger is positioned to confront the arbor in spaced relation, and when the arbor is rapidly rotated, the counterweight end is thrown outwardly by centrifugal force, moving the snagger toward the driven arbor to clampingly grip therebetween the leading end of the wire to be wound. Preferably, the elongated mounting member provides pivot means and is pivotably mounted on the driven arbor with the snagger on one side of the pivot means and the counterweight on the other side of the pivot means. The elongate mounting member may be arcuate in shape. In a preferred form, the arbor has a frustoconical face and the snagger is mounted on the mounting member to substantially parallel the frustoconical face and to move away from and toward the face a distance sufficient to allow the wire to be snagged between them and then to be clamped between them.

Desirably, the traversing means comprising idler sheaves over which the running wire is trained for traversing supply to the core of the reel to be wound, a lead screw fixedly mounted on the machine frame for traversing the idler sheaves along the length of the core, an X-Y table comprising bearings and tracks on which the bearings move, drive means for the lead screw, means fixedly mounting the drive means on the machine frame, and means for shifting the idler sheaves between a first position in which one of the driven arbors is to be driven and a second position in which the other of the driven arbors is to be driven.

Further objects, features, and advantages of the invention will become apparent from the following description and drawings.

DESCRIPTION OF A PRESENTLY PREFERRED EMBODIMENT

Figure 1:
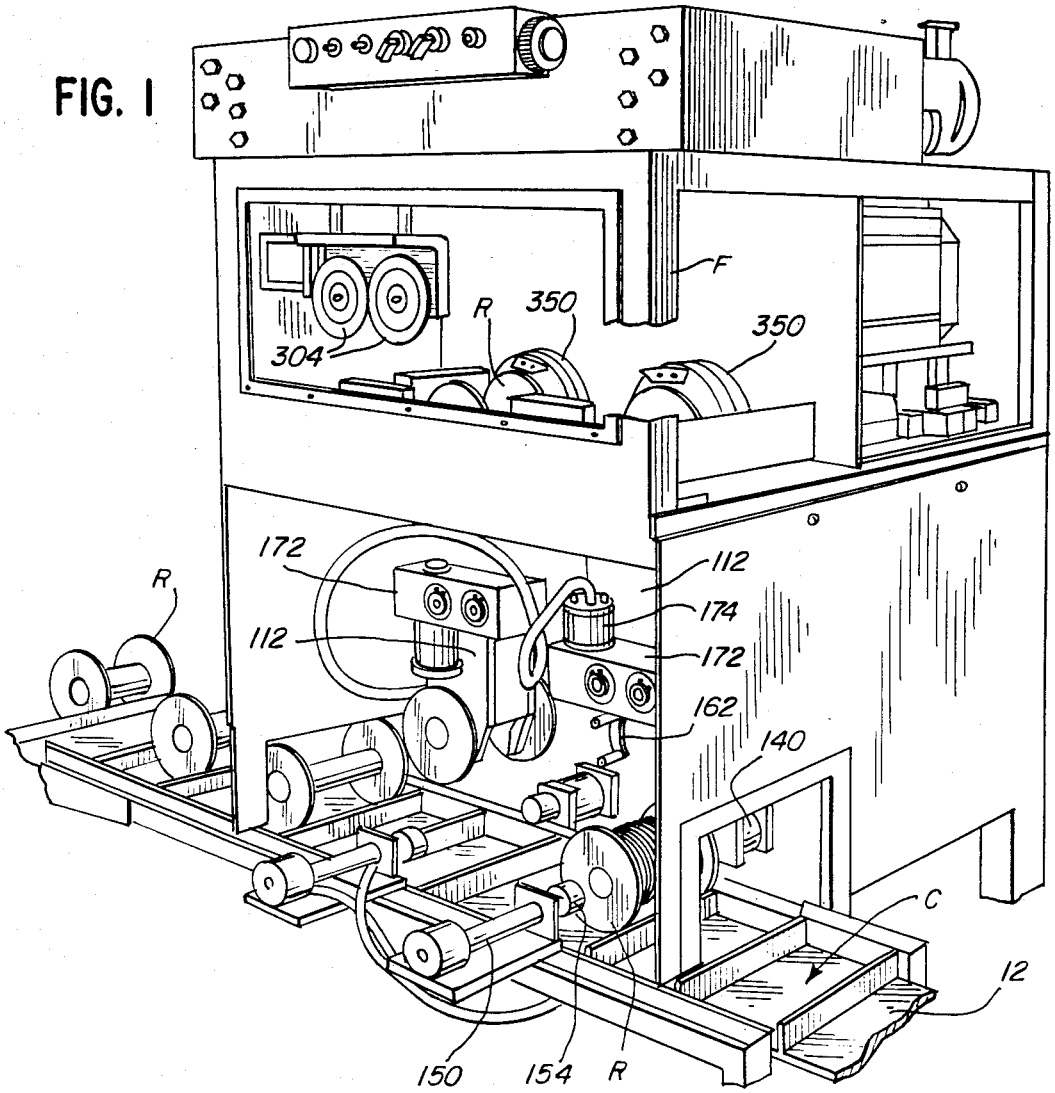
FIG. 1 is a front perspective of a winding machine of the present invention.

Referring now to the drawings, a dual reel winding machine 10 of the present invention is there shown. The machine 10 is supplied with reels R by a conveyor means, such as a continuous, driven conveyor 12 which is loaded from the left (FIG. 1) and which, when viewed from the perspective of FIGS. 1 and 3, and is driven and moves intermittently and unidirectionally from the left to the right. Reels R comprise a pair of spaced flanges and a central barrel or core on which wire is to be wound. The conveyor 12 is trained over a drive pulley and idler pulley (not shown) and is divided into a series of laterally open, adjacent, longitudinally oriented compartments C separated by upstanding, transversely oriented paddles P. Each compartment C is proportioned to receive, accommodate, and confine a reel R. Empty reels are supplied at one end of the conveyor and wound reels are discharged from the other end of the conveyor.

The conveyor 12 is adapted to be intermittently moved incrementally and to be stopped appropriately to present a pair of empty reels R at a pair of loading stations below the transfer means comprising the pair of robotic arm assemblies to be described, and to receive wound reels at the same stations, as will be described.

Each of the loading stations is disposed beneath a robotic arm assembly 100, 100' which may be identical and which are adapted to grip entry reels R and wound reels F, and to move and position them relative to the winding mechanism and conveyor.

Figure 3:
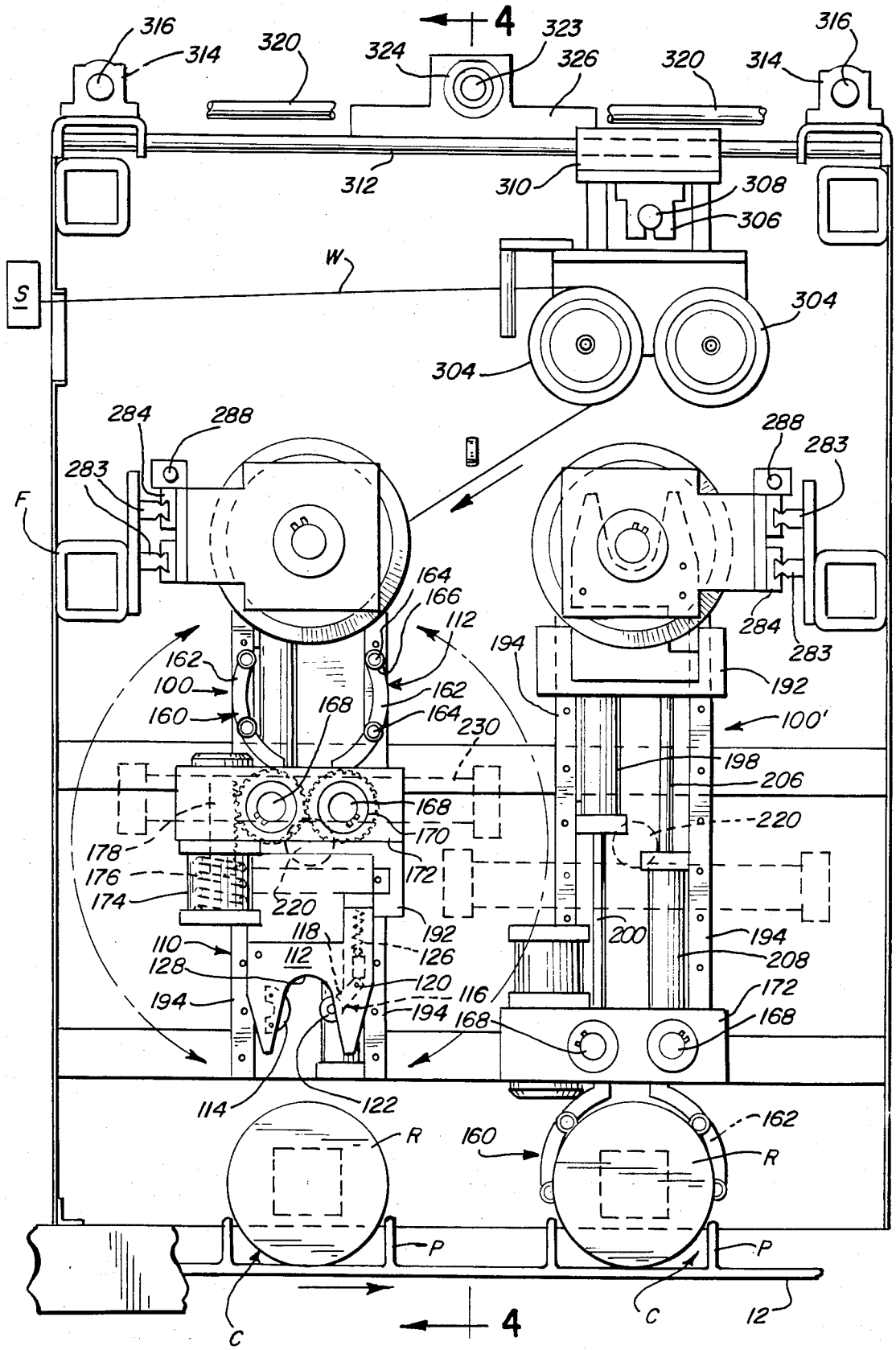
FIG. 3 is a front view of the winding machine of FIG. 1.

Referring now especially to FIG. 3, robotic arm assemblies 100, 100', each comprises a first empty reel gripper assembly 110 and a second full or wound reel gripper assembly 160. Empty reel gripper assembly 110 comprises a pair of spaced hands 112. Each hand 112 mounts a generally semi-circular fixed gripper 114 and pivotally supports a pivoted gripper member 116. Pivoted gripper member 116 comprises an arm 118 pivotally mounted on hand 112 at pivot 120. The arm is provided with a cam 122 which will cause the arm 118 to move when a reel barrel contacts it during the loading mode. The arms 118 are connected by a rod 124 which provides pivot pins for pivotally mounting the arms 118 at pivots 120. A compression spring 126 bears against a flattened portion of rod 124 to bias the rod 124 to the position shown in FIG. 3. When the hands are thrust downwardly to grip the barrel of a reel, the cams 122 will move outwardly against spring 126, and after the barrel has nested in the saddles 128 of the hands, the spring 126 will force the cams 122 inwardly so that the fixed gripper 114 and the pivoted gripper member 116 will grasp and hold the barrel of an empty reel in the space defined by the paddle, and the fixed and pivotal grippers.

It should be pointed out that the empty reels R are appropriately positioned laterally of the hands (hence, as will be described, relative to the arbors) by a pair of locating and stop means. Locating cylinder 140 (FIG. 4) is a double acting pneumatic cylinder and is mounted on the frame F of the machine. Its piston rod 142 mounts a stop 144 which is extended appropriately to stop the reel R in a desired position. The other locating cylinder 150 is a double-acting pneumatic cylinder, but is preferably operated at a lower force due to a differential in the area acted on by air pressure. Thus, its piston rod 152 and associated pusher 154 will push the reel R toward stop 144 to hold it in a desired position to be gripped by the hands 112. The use of lower pressure cylinder 150 will enable cylinder 140 to fix the position of the reel R and will also acommodate to reels R of different widths.

The wound reel gripper assembly 160 comprises a pair of powered grabbers 162 which are shown in their open positions in FIG. 3. Grabbers 162 comprise arcuate arms with pairs of stub axles 164. Stub axles 164 mount rollers, such as plastic sleeves or rollers 166 which may be made of polyvinyl chloride plastic and which are rotatable on axles 164. At their bases, grabbers 162 are mounted on shafts 168 which in turn are keyed to pinions 170. Pinions 170 and shafts 168 are rotatably journaled on grabber support 172.

Grabber support 172 mounts on air cylinder 174 which is juxtaposed with a spring 176. Spring 176 normally holds the grippers open (as seen in FIG. 3). However, when the cylinder 174 is activated, it compresses the spring 176 and causes the associated rack 178 to move upwardly as viewed in FIG. 3. The rack 178 causes the grabber pinions 170 to rotate and the grabbers to move inwardly to grip and grab a wound reel and to hold it.

In FIG. 3, the left hand robotic arm assembly 100 is in its retracted position, and ready to be spread or extended upwardly and downwardly to grip reels as appropriate. The right hand robotic arm assembly 100' is in its outward, projected or extended position of engagement with an empty reel at the top, and a wound reel at the bottom.

To extend and retract the hands and grabbers, suitable operating mechanisms are provided.

Referring first to the operating mechanism for the hands 112, it will be clear that they are supported by support arms 190 which in turn are connected to linear bearings 192. Linear bearings 192 are mounted on rails 194 which guide the bearings 192 as they move (are extended and retracted) therealong. Rails 194 are mounted on a robotic arm assembly frame, such as plate 196. A double acting cylinder 198 is mounted on the plate, with its piston 200 connected to the linear bearings 192. Thus, as the cylinder 198 is operated, the bearings 192 will move up and down along the plate causing the hands to move up and down relative to the plate 196.

Similarly, the grabber support 172 which mounts grabbers 162 is mounted on support arms 202. In turn, these are connected to linear bearings 204 which are mounted on the rails 194. Bearings 204 are connected to the piston 206 of cylinder 208 which is secured to the plate 196. Thus, as double acting cylinder 208 is operated, piston 206 is retracted (or extended) and the grabbers are caused to move up and down relative to the support plate 196.

The robotic arm assemblies 100, 100' are also mounted for oscillation through an arc of 180 degrees to reverse the positions of the grabbers 162 and the hands 112, i.e., to move them from the position on the left in FIG. 3 to that on the right, and back again. To that end, a shaft 220 is provided for each robotic arm assembly. Shaft 220 is mounted on the machine frame F in suitable bearings 222. At one end the shaft is fixed to a flange 224 which is secured, as by several bolts 226, to the plate 196. The shaft 220 is oscillated by a frame mounted, cylinder activated rotary torque actuator 230. Rotary torque actuator 230 comprises a double acting cylinder which drives a rack internally of the sealed actuator 230. The rack drives an internal sealed pinion 232 which in turn drives a connected shaft 234 which extends externally of the actuator 230. The shaft 234 is provided with a coupling 236 which is coupled to shaft 220. Thus, when the plate 196 is to be oscillated from the position on the left of FIG. 3 to that on the right of FIG. 3, and back again, actuator 230 is operated in the selected direction.

Figure 4:
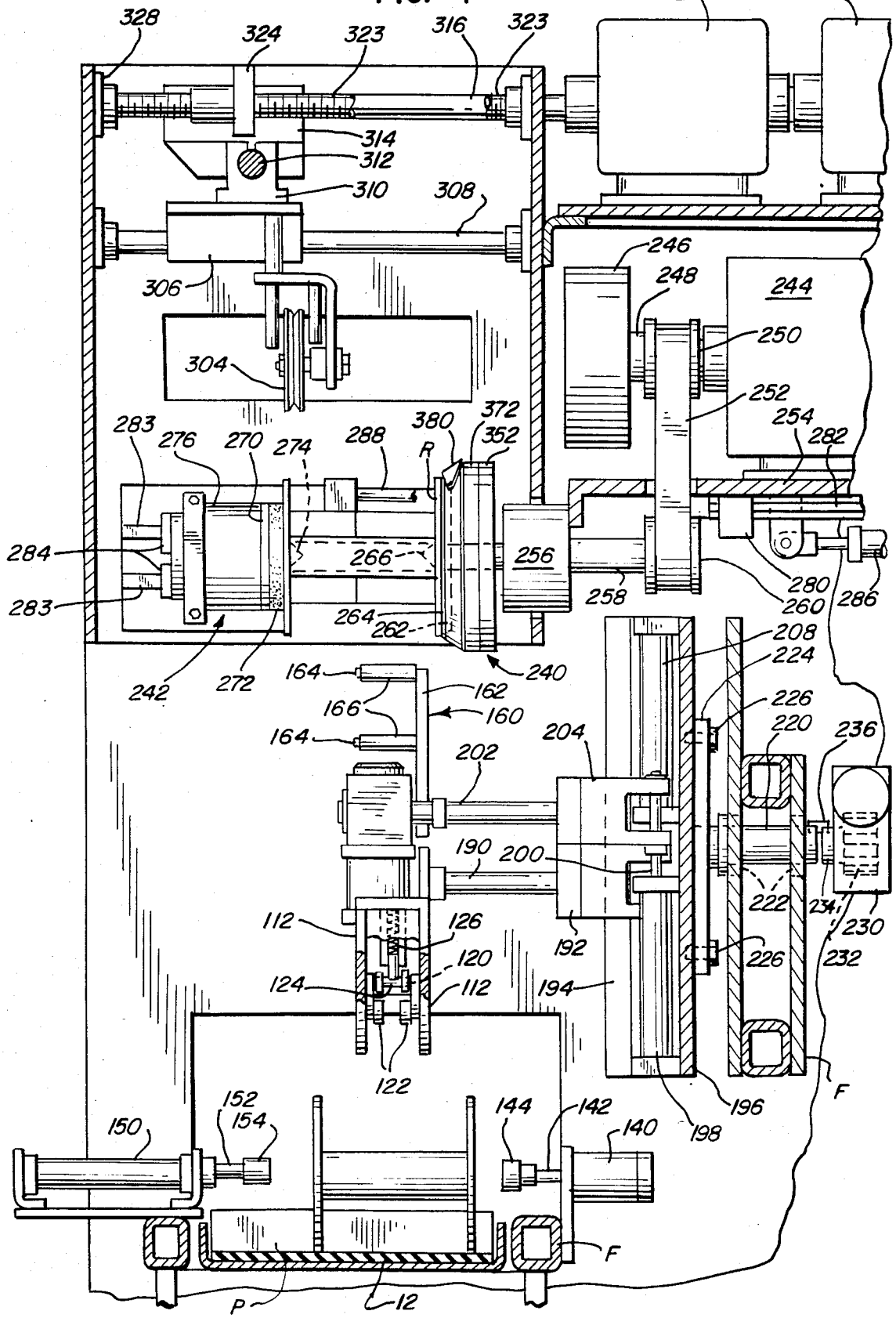
FIG. 4 is a view, partially in cross-section, taken substantially along line 4—4 of FIG. 3.

Referring now to FIG. 4, two pairs of arbor means for mounting the reels for rotation and winding are shown. Each arbor means comprises a driven arbor 240 and an idler arbor 242.

Driven arbor 240 comprises a motor 244, a brake 246 and a drive shaft 248. Drive shaft 248 mounts a pulley 250 over which a toothed drive belt 252 is trained. The support member 254 for the motor and brake mounts a bearing housing 256 through which an arbor drive shaft 258 extends. At one end the arbor drive shaft 258 mounts a pulley 260 over which belt 252 is trained. At the other end, the shaft 258 mounts the driven arbor 240 and a snagger plate assembly.

The driven arbor 240 comprises an arbor plate 262, a rubber pad 264 adapted to frictionally engage the side of a reel R and an arbor point 266 proportioned to enter the reel barrel and to center same on the point, hence on the shaft 258. The snagger plate assembly will be described later.

The idler arbor 242 comprises a plate 270, a rubber pad 272 and a point 274. These are mounted on a shaft which is journalled in a bearing housing 276.

Each of the arbors is mounted for movement toward and away from the reels R to be wound so that they may be released after being wound and so that they may compressively grip a reel for rotation when presented for winding. To that end, as illustrated by FIG. 3, each of the arbors is provided with locating and stop means, including a double acting cylinder, and is mounted on linear bearings and bearing rails which are frame supported. Thus, as seen in FIG. 4, a pair of the driven arbor support member 254 mounts linear bearings 280, only one of which is shown, which are mounted for movement along rails 282. In turn, the rails 282 are fixed to the machine frame F. Similarly, the bearing housing 276 for the idler arbor 242 is secured to a support element which in turn is provided with linear bearings 284 which are also supported for movement along rails 283.

The driven arbor is moved along rails 282 by a first double acting cylinder 286 and the idler arbor is moved along rails 282 by a second double acting cylinder 288. Preferably, like the locating cylinders 140, 150, the driven arbor first double acting cylinder 286 is stronger and is therefore the one which positively positions the driven arbor in a selected location. The other cylinder is of a lesser strength, due to a differential in the area acted on by the air pressure, and has a rod 288, and therefore positions the idler arbor in a gripping and compressive relationship to the driven arbor to accommodate, among other things, to variations in lengths of reel barrels.

After the reel to be wound is properly gripped between the arbors, it is caused to rotate by the driven arbor 240, via belt 252 and motor 244.

Figure 2:
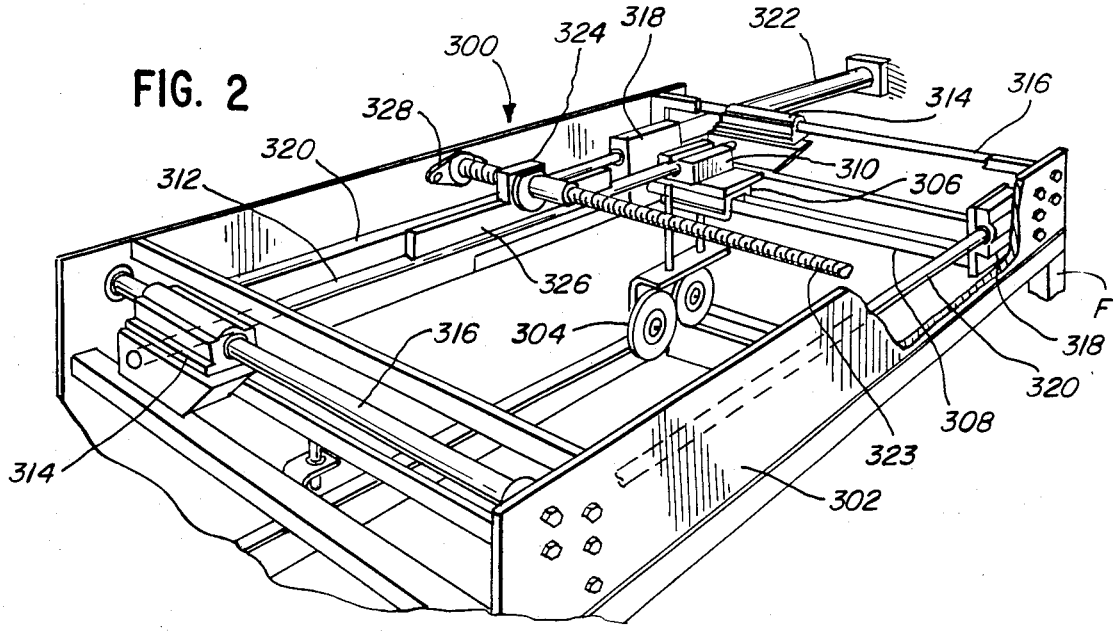
FIG. 2 is a top perspective view of the idler sheave traversing and moving assembly of FIG. 1.

So that the running wire, supplied from a wire source S, will be evenly spread on the core of the reel and so that the wire will be properly supplied to the reels as they are being wound, a traversing means, such as an X-Y table 300, is provided (FIG. 2). X-Y table 300 comprises a support frame 302 mounted on frame F and includes idler feeding sheaves 304 over which the running wire runs and a mechanism for traversing them relative to the lengths of the cores of the reels between the end flanges of the reels and for moving them from a position overlying one robotic arm assembly 100' as shown in FIG. 3 to a position overlying the other robotic arm assembly 100.

Sheaves 304 are supported on a first linear bearing 306 which is open at its bottom to move along a track such as a linear roundway 308 and by a second linear bearing 310 which is open at its top to move along linear roundway 312. Roundway 312 is supported at its ends on linear bearings 314 which move on roundways 316.

Linear roundway 308 is connected at its end to linear bearings 318. In turn, bearings 318 are supported for movement along roundways 320. One of the linear bearings 318 is connected with a double acting cylinder 322. Hence, sheaves 304 may be moved between the two positions, one overlying each of the robotic arm assemblies 100, 100' via a frame-mounted cylinder 322 which drives the sheaves 304 via linear bearings 318 along linear roundways 320.

To cause the sheaves to transverse a reel, a lead screw 323 which is fixedly mounted to the frame for rotation is provided. Screw 323 is threadingly journalled in a ball nut 324. Ball nut 324 is fixed to a connector plate 326 which in turn is fixed to roundway 312. An unthreaded end of the lead screw 323 is rotatably mounted in a flange block bearing 328. As such, as the lead screw is rotated, it will cause the ball nut 324 to transverse a reel, i.e., move along the length of the lead screw. Of course, that will cause the roundway 312 to move transversely, carrying with it the linear bearings 314 (which move along roundways 316) and bearing 306, which moves along roundway 308. It will be seen that all of this is easily and simply accomplished with a single lead screw 323.

The lead screw 323 is driven (see FIG. 4) by a drive means, such as a reversing DC motor 330, through a speed reducer 332, the output shaft of which is coupled to the lead screw. The motor and speed reducer are fixedly supported on the frame F, rather than moving with the traversing mechanism, thereby reducing the possibility of breakdown endemic in existing winders.

Figure 6:
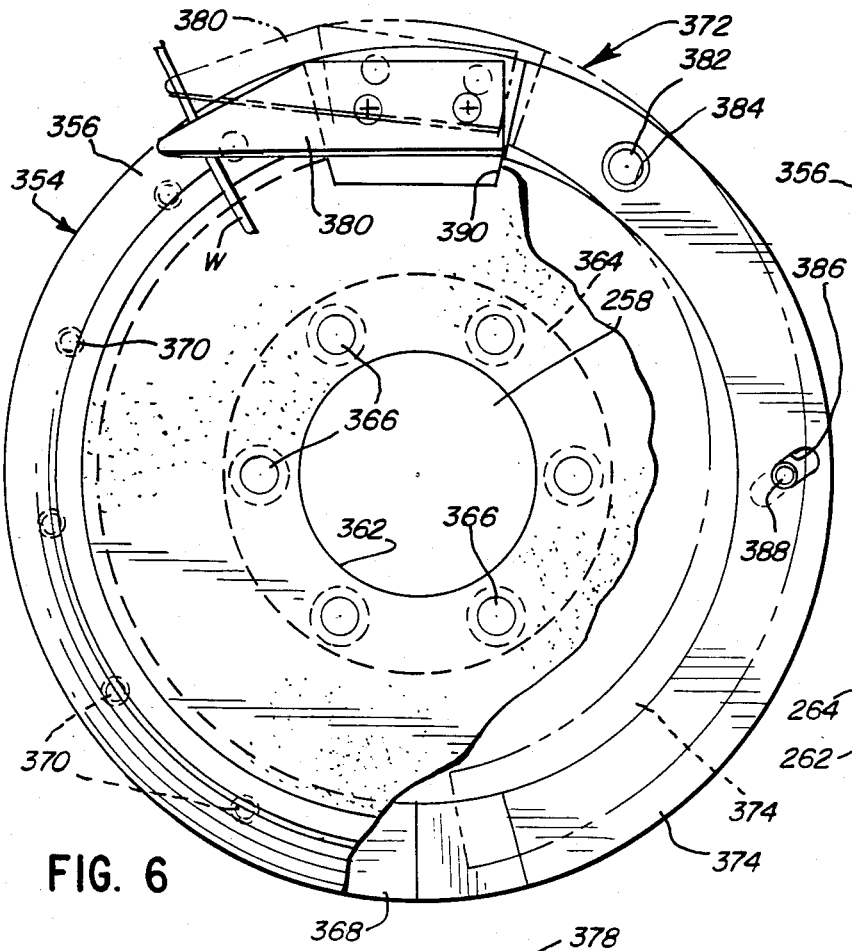
FIG. 6 is a front view of the snagger assembly.
Figure 7:
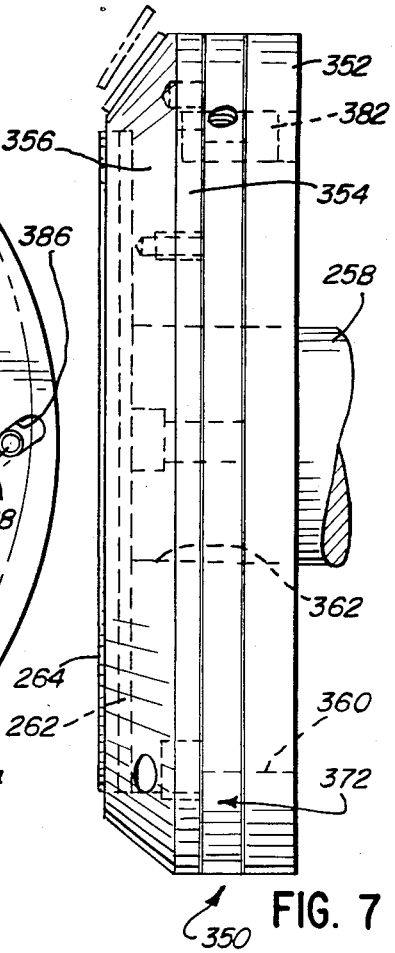
FIG. 7 is a side elevational view of the snagger assembly of FIG. 6.
Figure 8:
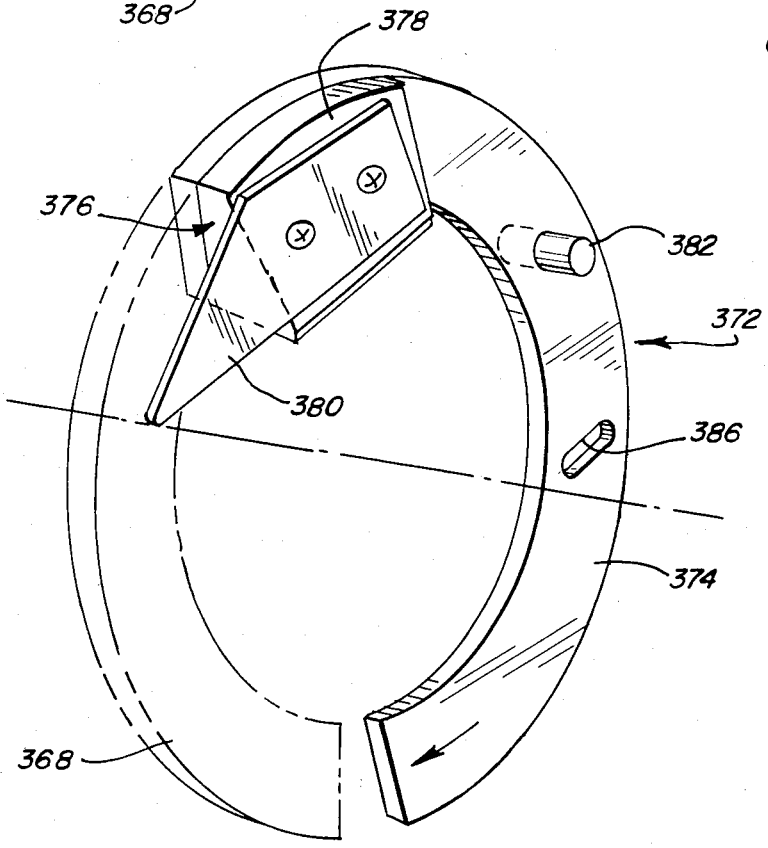
FIG. 8 is a perspective view of the moveable snagger element of the snagger assembly of FIG. 6.

FIGS. 6–8 illustrate the improved snagger plate assembly 350 of the present invention. Assembly 350 includes a generally flat backing plate 352, a front plate 354 having a frustoconical face 356 and a central moveable snagger member 372.

The flat backing plate is circular and annular and defines a central opening 360. It defines a plurality of tapped holes for screws to be threadingly secured to the front plate 354.

The front plate defines a central opening 362 to receive the arbor drive shaft 258 and a rearwardly extending concentric hub or sleeve 364. The end of the arbor drive shaft 258 provides an enlarged shoulder which confronts the shaft hub. The shoulder and hub are suitably tapped and a plurality of threaded bolts 366 are used to connect them to each other.

The front plate 354 and backing plate 352 are spaced apart by a parti-annular spacing plate 368 which is threadingly secured to them by a plurality of threaded bolts 370. The spacing plate 368 is of approximately the same width as the width of the backing plate, and extends for approximately 165 degrees only, thereby leaving a space between the backing plate and filler plate along their circumferences of about 195 degrees. It is in this space that the moveable snagger member 372 is mounted. Moveable snagger element comprises an elongate, generally flat main body 374 which is parti-annular and arcuate, conforming generally to the outer circumference of the backing plate and front plate.

At one end it mounts a spacer 376 which in cross-section conforms in shape generally to the cross-section of the front plate 354. Thus, it has an inclined face 378 which is proportioned to be substantially in the plane of the frustoconical face 356 of the front plate 354. A snagger 380 is secured to the inclined face 378 by bolts which secure the snagger 380, the spacer 376, and the main body 374 together at one end of the main body.

The snagger member 372 mounts a pivot pin 382 which extends forwardly and rearwardly of the main body 374 and which is disposed in complementary openings 384 in the front and backing plates. Bushings may be provided in the openings. The pivot pin 382 is positioned at a distance of about 50 degrees from the end of the snagger element mounting the snagger and at about 130 degrees from the other end.

At a distance of about 55 degrees from the pivot pin, the main body 374 is provided with a slot 386. The slot 386 lies in the direction of an arc taken along the pivot pin 382 as its center. A keeper pin 388 secured to the backing plate 352 projects into the slot 386 to limit movement of the snagger member 372 about the pivot pin 382.

As seen in FIGS. 6 and 7, the front plate 354 is cut out or notched at notch 390 in the zone of the spacer 376 so that when the snagger member 372 is juxtaposed with the front plate and backing plate, the face 378 of spacer 376 will lie substantially along the face 356 of the front plate 354. The notch 390 is sufficiently wide to permit the necessary movement of the snagger member which will now be described.

The portion of the snagger member to the rear of the pivot pin 382 is heavier than the portion including the snagger 380 forwardly of the pivot pin. As such, it serves as a counterweight pivoting the snagger in a clockwise direction as seen in dotted line in FIG. 6. As such, when the driven arbor is at rest, the generally triangular free end of the snagger 380 will confront, but be spaced away from, the underlying frustoconical portion of face 356 of the front plate 354. However, when the arbor is rapidly rotated, because the other end of the snagger member 372 is heavier, it will be thrown outwardly due to centrifugal force and the free end of the snagger 380 will move about pivot pin 382 to the full line position of FIGS. 6 and 7, thereby clampingly gripping the snagged end, the leading end, of the wire W between the snagger 380 and face 356. The range of movement of the snagger between the dotted line position of rest shown in FIGS. 6 and 7 and the full line position of rotation of the driven arbor 240 shown in those Figures is controlled by the slot 386 and the keeper pin 388.

Figure 9:
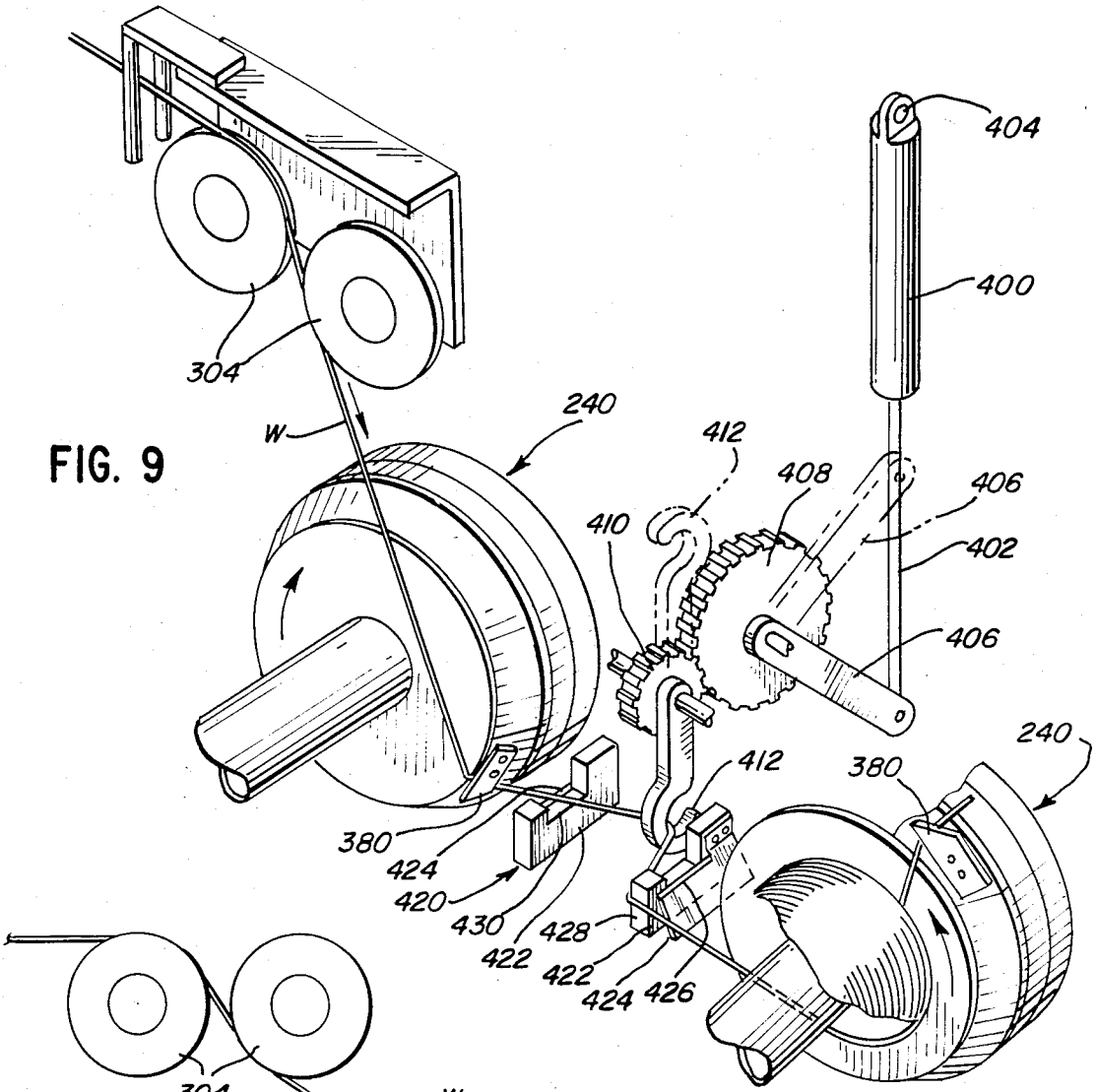
FIG. 9 is a perspective view of the cut-over mechanism.

The cut-over mechanism by which the wire is diverted from a wound reel to an empty reel for cutting, and is presented to the snagger to be cut immediately thereafter, is shown in FIG. 9. The counter-rotating driven arbors 240 are shown with the snaggers 380. When the cut-over is to occur, frame-mounted pneumatic cylinder 400 is activated, driving its rod 402 downwardly. Cylinder 400 is mounted on a pivot 404 to permit oscillation thereabout. The rod 402 pivotably mounts a crank arm 406 which, at its other end, co-rotatably mounts a gear 408. Gear 408 is oscillatably mounted on the frame F.

As the rod 402 descends, the gear 408 oscillates and causes a further toothed gear 410 to oscillate. Gear 410 is also oscillatably mounted on the frame. Gear 410 and gear 408 are in a ratio of 1:2, so that movement of gear 408 through 90 degrees oscillates gear 410 through 180 degrees.

Gear 410 is corotatably coupled with a snagger hook 412 which moves with gear 410 through an arc of about 180 degrees from an inaction position of rest to an active position of hooked engagement. As it moves, the hook 412 engages and hooks the wire W, drawing it downwardly and inwardly into a plane at which it may be intercepted by the snagger 380 of the driven arbor which mounts the empty reel which is next to be wound.

As the hook descends, it brings the wire into engagement with the blocker and cutter assemblies 420. Each comprises a generally U-shaped blocker 422 and an associated inclined cutter blade 424 replaceably bolted to the blocker. The cutter blades are sharpened at their upper edges 426. As the hook 412 further descends, it brings the running wire into engagement with the side surface 428 of the blocker for the wound reel, keeping the wire W inwardly of the reel and restraining the running wire from entering the path of snagger 380 for the wound reel.

Figure 10A:
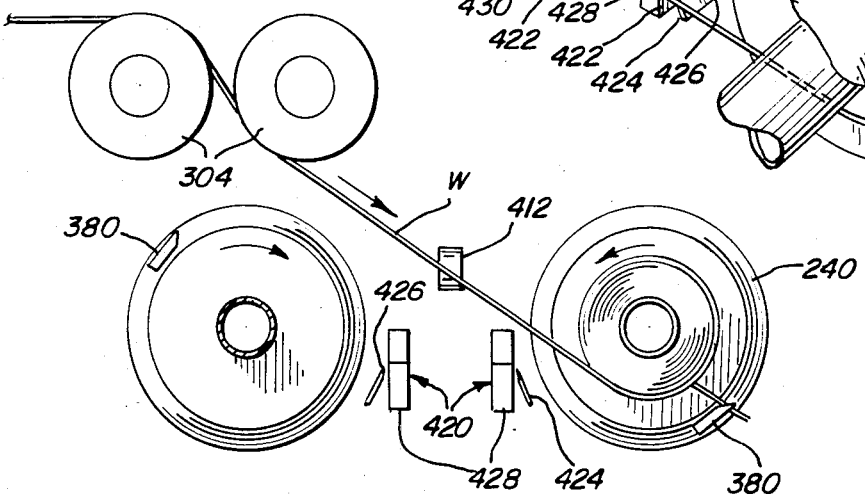
FIG. 10A is a side elevational schematic view of a portion of the cut-over mechanism at rest.
Figure 10B:
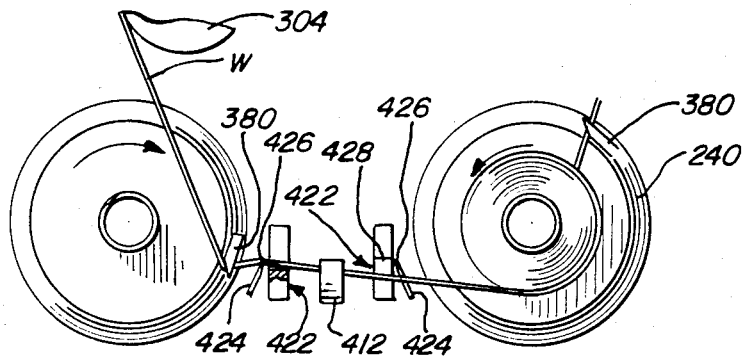
FIG. 10B is a side elevational schematic view of a portion of the cut-over mechanism in an operational position.

The hook 412 carries the wire outwardly relative to the blocker 422 for the empty reel and into the plane or path of the snagger 380 for the empty reel and into the yoke 430 of the empty reel blocker. When the snagger 380 snags the wire, it carries the wire downwardly relative to the yoke 430 of the blocker and the aligned cutter blade, and draws it into cutting engagement with the edge 426 of cutter blade 424, as illustrated in the transition from FIG. 10A to FIG. 10B. The cutter blade edge 426 extends above the edge of the yoke 430. When forced against that edge, the wire is cut. After cutting, the freed end of the wire remains with the wound reel, and the wound reel is ready for removal from the machine by the grabbers 262. The other wire end remains captured by the snagger 380 on the empty reel which commences to wind.

When that reel is wound, the position of the idler feeding sheaves 304 will have reversed and the cutter blade of the other blocker will serve to cut the wire in the manner described.

Referring now to FIGS. 5A to 5L, the sequence in which the robotic arms are operated and used relative to the reels R are there illustrated.

Figure 5A:
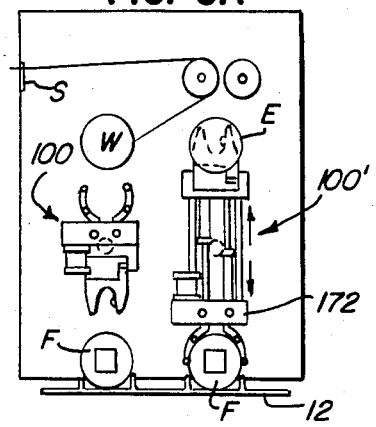
FIG. 5A–5L illustrate, in sequence, the operation of the robotic arm assemblies of FIG. 1.

As shown in FIG. 5A, robotic arm assembly 100 is in its normal inoperative position of rest. A reel R which is full (reel F) has been previously removed from the arbors and a reel shown as being wound (W) is above assembly 100. The full reel which was wound immediately before on the arbors above assembly 100′ is being deposited on the conveyor 12 in a compartment C and an empty reel E is being positioned between the arbors above assembly 100′.

Figure 5B:
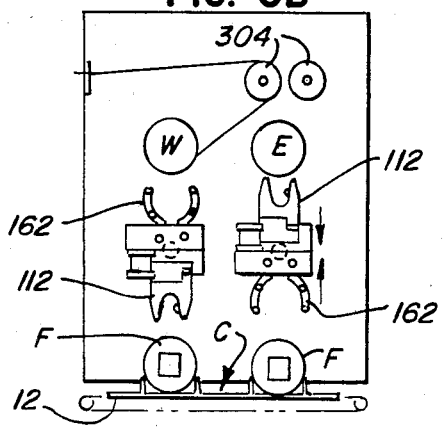
Figure 5C:
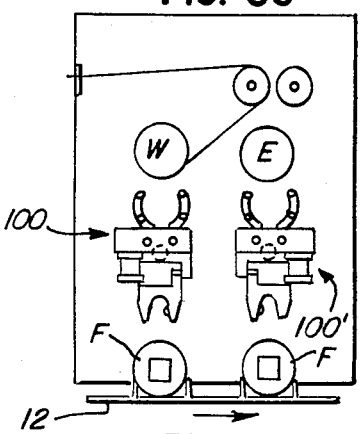

In FIG. 5B, the hands 112 and grabbers 162 of assembly 100′ have been retracted by cylinders 198, 208, the empty reel E is ready for use and the conveyor 12 is ready to be indexed to bring two empty reels E to positions below assemblies 100, 100′. Assembly 100′ has also been rotated on shaft 220 to present the assembly 100′ in its normal position of rest (FIG. 5C).

When the winding above assembly 100 is completed, the wire is switched to the empty reel above assembly 100′ and is cut, winding commences on the reel above assembly 100′, and the sheaves 304 are shifted to the left to prepare for the next cut-over.

Figure 5D:
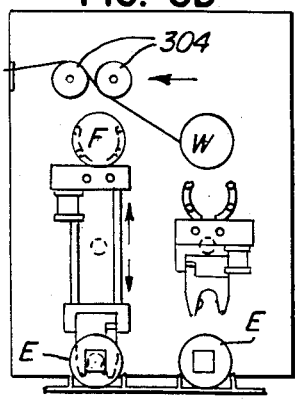
Figure 5E:
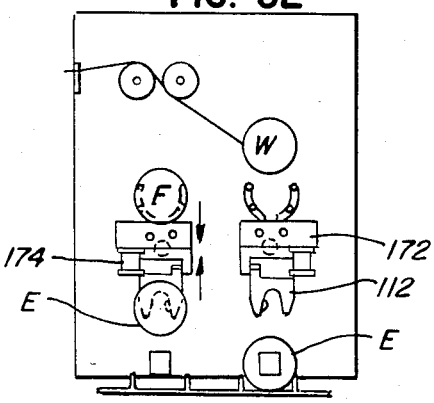
Figure 5F:
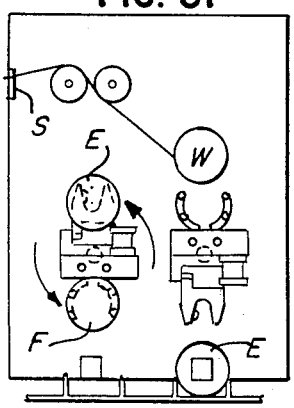
Figure 5G:
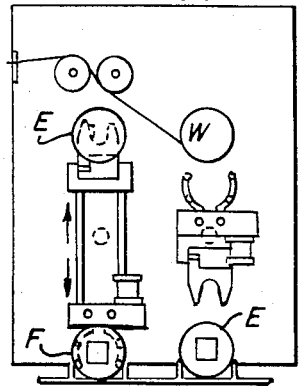

At that time, as shown by FIG. 5D, the full reels shown in FIG. 5C have been indexed to be discharged from the machine and two empty reels are presented for subsequent use below assembly 100. The assembly 100 is then expanded to grip the full reel above assembly 100 and an empty reel below it. The assembly 100 is then retracted to the position of FIG. 5E and rotated (FIG. 5F). If the wire is "hung up", the positive pull of the grabbers as the wound reel is retracted from the position of FIG. 5D will pull out the "hung-up" wire. In conventional machines, elevator mechanisms do not provide a positive tugging force. The assembly 100 is then expanded again to present an empty reel to the arbors above assembly 100 and to deposit the wound reel on the conveyor 12 below assembly 100 (FIG. 5G). The arbors are closed to grip the reel, the assembly is retracted (FIG. 5H), following which assembly 100 is rotated to its normal position of rest (FIG. 5I).

Figure 5H:
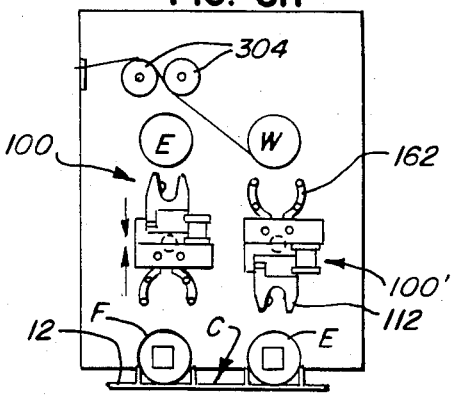
Figure 5I:
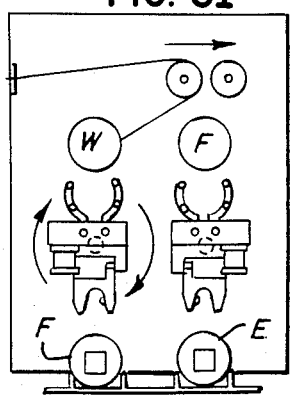
Figure 5J:
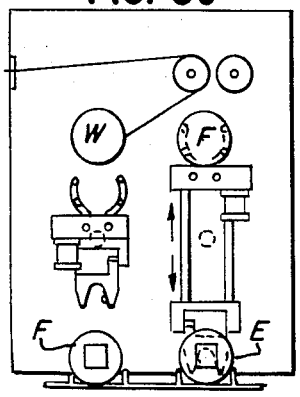
Figure 5K:
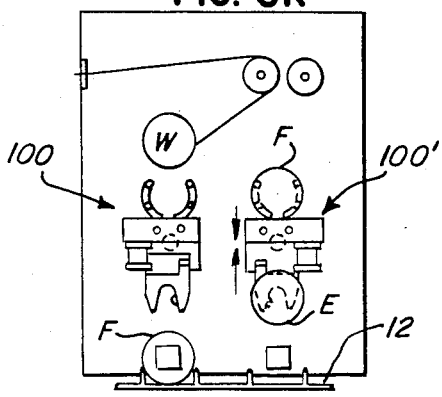
Figure 5L:
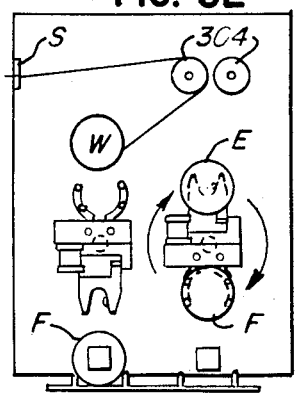

After the next cut-over occurs between the positions of FIGS. 5H and 5I, the assembly 100′ is expanded to the position of FIG. 5J, to grip the empty reel on the conveyor and the full reel on the arbors above assembly 100′. The assembly 100′ is then retracted (FIG. 5K) and is rotated (FIG. 5L). The assembly 100′ is then ready to expand to the position of FIG. 5A, and to continue the winding operation as described.

Thus, it will be seen that the robotic arm assembly effectively and efficiently provides for continuous winding of wire reels. The machine has been found to efficiently wind at the rate of 1000 feet per minute, filling four reels of 250 feet per minute for extended periods of time. The winding machine receives reels from one side of the machine and discharges them from the other, facilitating unidirectional movement of the conveyor and of the wound reels for discharge from the machine.

The machine may be under the control of a microprocessor which will program the functions referred to, activating the pneumatic cylinders at the appropriate times so that the machine will function in timed sequence. The controls have not been described in detail because it will be apparent to those skilled in the art how they may be constructed to energize the several cylinders and motors to carry out the functions described in detail herein.

It will be apparent to those skilled in the art that modifications may be made in the dual winding machine as described without departing from the spirit and scope of the invention. Accordingly, the invention is not to be considered as being limited except insofar as may be appropriate in view of the appended claims.

What is claimed is:

1. A continuous wire winding machine for winding wire on reels having a pair of spaced flanges connected by a central core, said machine comprising, a machine frame, conveyor means for supplying empty reels to and removing wound reels from the machine, two pairs of arbor means for gripping and rapidly rotating reels for the winding of wire thereon, one of each of said pairs being a driven arbor, transfer means for transferring empty reels from said conveyor means and wound reels to said conveyor means, said transfer means comprising a pair of robotic arm assemblies, each assembly comprising a first gripper for grasping an empty reel at one end of the assembly and a second gripper for grabbing a wound reel at the other end of the assembly, shaft means mounting each said robotic arm assembly for oscillation of said assembly through an arc of 180°, and means for oscillating said shaft, and driving means mounting said grippers for moving them between an outwardly extended position and an inwardly retracted position relative to said assembly and said shaft, whereby when said grippers are in their extended positions, they are enabled alternatively to present an empty reel between a pair of said arbors and to grab a wound reel positioned between said pair of arbors, and when said grippers are in their retracted positions, the assembly is enabled to be oscillated about the axis of said shaft.

2. A continuous wire winding machine in accordance with claim 1, and wherein each first gripper comprises hands for facilitating gripping the core of a reel, and each second gripper comprises powered grabbers for clampingly grasping a wire wound core, each for holding same for movement and for transfer and presentation to the arbor means and to the conveyor means, respectively.

3. A continuous wire winding machine in accordance with claim 2, and further comprising first locating and stop means for positioning said reels lengthwise relative to said conveyor means and further locating and stop means for positioning said arbor means relative to said reels.

4. A continuous wire winding machine in accordance with claim 1, and wherein said second gripper comprises a pair of grabbers and powered means for opening and closing said grabbers, said powered means comprising a spring normally holding said grabbers in an open position and driving means acting to move said grabbers to a closed position in which a wound reel is to be grabbed.

5. A continuous wire winding machine for winding wire on reels having a pair of spaced flanges connected by a central core, said machine comprising, a machine frame, a pair of transfer means for transferring empty reels from a conveyor means and wound reels to a conveyor means, conveyor means for supplying empty reels to and removing wound reels from the machine, said conveyor means comprising a continuous conveyor defining compartments for confining reels and for presenting empty reels to each of said transfer means and for receiving wound reels from said transfer means, and means for intermittently driving said conveyor, two pairs of arbor means for gripping and rapidly rotating reels for the winding of wire thereon, one of each of said pairs being a driven arbor, means for traversing running wire supplied from a wire supply along the length of the core of a reel to spread the wire evenly on said core, and means for diverting the wire from a wound reel to an empty reel and for cutting the wire to commence winding of an empty reel.

6. A continuous wire winding machine in accordance with claim 5, and wherein said conveyor is provided with upstanding transversely oriented paddles separating the conveyor into a series of longitudinally oriented compartments proportioned to receive reels.

7. A continuous wire winding machine in accordance with claim 5, and wherein said transfer means comprises a pair of robotic arm assemblies, each assembly comprising a first gripper for grasping an empty reel at one end of the assembly and a second gripper for grabbing a wound reel at the other end of the assembly, shaft means mounting each said robotic arm assembly for oscillation of said assembly through an arc of 180°, and means for oscillating said shaft, and driving means mounting said grippers for moving them between an outwardly extended position and an inwardly retracted position relative to said assembly and said shaft, whereby when said grippers are in their extended positions, they are enabled alternatively to present an empty reel between a pair of said arbors and to grab a wound reel positioned between said pair of arbors, and when said grippers are in their retracted positions, the assembly is enabled to be oscillated about the axis of said shaft.

8. A continuous winding machine in accordance with claim 7, and wherein said arm assemblies are in their extended positions they are further enabled alternatively to grip empty reels on said conveyor and to deposit wound reels in compartments of said conveyor, and wherein said conveyor is driven to move intermittently.

9. A continuous wire winding machine for winding wire on reels having a pair of spaced flanges connected by a central core, said machine comprising, a machine frame, conveyor means for supplying empty reels to and removing wound reels from the machine, transfer means for transferring empty reels from said conveyor means and wound reels to said conveyor means, two pairs of arbor means for gripping and rapidly rotating reels for the winding of running wire thereon, one of each of said pairs being a driven arbor, each said arbor means having a snagger for snagging a leading end of a wire section of a running wire to be wound on a reel, means for traversing running wire supplied from a wire supply along the length of the core of a reel to spread the wire evenly on said core, means for diverting the wire from a wound reel to an empty reel and for cutting the wire to commence winding of an empty reel, said diverting and cutter means comprising blocker means having associated cutters and a hook mounted for movement between an inactive position of rest and an active position of hooked engagement with the running wire, said hook and said blocker means being so positioned that when said hook moves toward and into said position of hooked engagement, it carries the running wire into engagement with the blocker means for a wound reel and into the path of the snagger of the empty reel arbor, and said empty reel arbor snagger then draws the wire across the cutter of the empty reel arbor blocker means to cut same.

10. A continuous wire winding machine in accordance with claim 9, and wherein said blocker means comprises a pair of blockers, each having its own cutter, one for each pair of arbor means, and wherein each said blocker provides a surface against which said hook is adapted to carry the running wire into engagement when the blocker is associated with an arbor for a wound reel.

11. A continuous wire winding machine in accordance with claim 10, and wherein each blocker defines a yoke with the cutter being disposed in line with the yoke, said blockers being positioned so that said blocker surface which the running wire engages restrains the running wire from entering the path of the wound reel snagger.

12. A continuous wire winding machine for winding wire on reels having a pair of spaced flanges connected by a central core, said machine comprising, a machine frame, conveyor means for supplying empty reels to and removing wound reels from the machine, transfer means for transferring empty reels from said conveyor means and wound reels to said conveyor means, two pairs of arbor means for gripping and rapidly rotating reels for the winding of wire thereon, one of each of said pairs being a driven arbor, and including a snagger means for snagging a leading end of the running core to be wound on an empty reel, means for traversing running wire supplied from a wire supply along the length of the core of a reel to spread the wire evenly on said core, means for diverting the wire from a wound reel to an empty reel and for cutting the wire to commence winding of an empty reel, said snagger means comprising an elongated mounting member and having a snagger adjacent one end thereof, the other end of said elongated mounting member comprising a counterweight, whereby, when said driven arbor is at rest, said snagger is positioned to confront said driven arbor in spaced relation, and when said driven arbor is rapidly rotated, the counterweight end is thrown outwardly by centrifugal force, moving said snagger toward said driven arbor to clampingly grip therebetween the leading end of the wire to be wound.

13. A continuous wire winding machine in accordance with claim 12, and wherein said elongated mounting member provides pivot means and is pivotably mounted on said driven arbor with said snagger on one side of said pivot means and said counterweight on the other side of said pivot means.

14. A continuous wire winding machine in accordance with claim 13, and wherein said elongate mounting member is arcuate in shape.

15. A continuous wire winding machine in accordance with claim 13, and wherein said driven arbor has a frustoconical face and said snagger is mounted on said mounting member to substantially parallel said frustoconical face and to move away from and toward said face a distance sufficient to allow the wire to be snagged between them and then to be clamped between them.

16. A continuous wire winding machine in accordance with claim 12, and wherein said diverting and cutting means comprises blocker means having associated cutters and a hook mounted for movement between an inactive position of rest and an active position of hooked engagement with the running wire, said hook and said blocker means being so positioned that when said hook moves toward and into said position of hooked engagement, it carries the running wire into engagement with a surface of the blocker means for the wound reel and into the path of the snagger of the empty reel arbor, and said empty reel arbor snagger then draws the wire across the cutter of the empty reel arbor blocker means to cut same.

17. A continuous wire winding machine for winding wire on reels having a pair of spaced flanges connected by a central core, said machine comprising, a machine frame, conveyor means for supplying empty reels to and removing wound reels from the machine, transfer means for transferring empty reels from said conveyor means and wound reels to said conveyor means, two pairs of arbor means for gripping and rapidly rotating reels for the winding of running wire thereon, one of each of said pairs being a driven arbor, means for diverting the wire from a wound reel to an empty reel and for cutting the wire to commence winding of an empty reel, means for traversing running wire supplied from a wire supply along the length of the core of a reel to spread the wire evenly on said core, said traversing means comprising idler sheave means over which the running wire is trained for traversing supply to the core of the reel to be wound, a lead screw fixedly mounted on said machine frame for traversing said idler sheaves along the length of the core to be wound, an X-Y table comprising bearings and tracks on which said bearings move, drive means for said lead screw, and means fixedly mounting said drive means on said machine frame.

18. A continuous wire winding machine in accordance with claim 17, and further comprising powered means for shifting the idler sheaves between a first position in which one of said driven arbors is to be driven and a second position in which the other of said driven arbors is to be driven.

19. A continuous wire winding machine for winding wire on reels having a pair of spaced flanges connected by a central core, said machine comprising, a machine frame, a compartmented conveyor for supplying empty reels to and removing wound reels from the machine, robotic arm transfer means for transferring empty reels from said conveyor means and wound reels to said conveyor means, two pairs of arbor means for gripping and rapidly rotating reels for the winding of wire thereon, one of each of said pairs being a driven arbor, means for traversing running wire supplied from a wire supply along the length of the core of a reel to spread the wire evenly on said core, and blocker and hook means for diverting the wire from a wound reel to an empty reel and for cutting the wire to commence winding of an empty reel.

20. A continuous wire winding machine in accordance with claim 19, and wherein said robotic arm transfer means comprises a pair of robotic arm assemblies, each assembly comprising a first gripper for grasping an empty reel at one end of the assembly and a second gripper for grabbing a wound reel at the other end of the assembly, shaft means mounting each said robotic arm assembly for oscillation of said assembly through an arc of 180°, and means for oscillating said shaft, and driving means mounting said grippers for moving them between an outwardly extended position and an inwardly retracted position relative to said assembly and said shaft, whereby when said grippers are in their extended positions, they are enabled alternatively to present an empty reel between a pair of said arbors, and when said grippers are in their retracted positions, the assembly is enabled to be oscillated about the axis of said shaft.

21. A continuous wire winding machine in accordance with claim 20, and wherein each first gripper comprises hands for facilitating gripping the core of a reel, and each second gripper comprises powered grabbers for clampingly grasping a wire wound core, each for holding same for movement and for transfer and presentation to the arbor means and to the conveyor means, respectively.

22. A continuous wire winding machine in accordance with claim 19, and wherein each driven arbor has a snagger associated therewith for snagging a leading end of a wire section of a running wire to be wound on a reel, and wherein said blocker and hook means comprises a pair of blockers, each having associated cutters, one for each pair of arbor means, and a hook mounted for movement between an inactive position of rest and an active position of hooked engagement with the running wire, said hook and said blockers being so positioned that when said hook moves toward and into said position of hooked engagement, it carries the running wire into engagement with a surface of the blocker for the wound reel and into the path of the snagger of the empty reel arbor, and said empty reel arbor snagger then draws the wire across the cutter of the empty reel arbor blocker to cut same.

23. A continuous wire winding machine in accordance with claim 19, and wherein each said driven arbor includes snagger means, said snagger means comprising an elongated mounting member and having a snagger adjacent one end thereof, the other end of said elongated mounting member comprising a counterweight, whereby, when said driven arbor is at rest, said snagger is positioned to confront said driven arbor in spaced relation, and when said driven arbor is rapidly rotated, the counterweight end is thrown outwardly by centrifugal force, moving said snagger toward said driven arbor to clampingly grip therebetween the leading end of the wire to be wound.

24. A continuous wire winding machine in accordance with claim 23, and wherein said elongated mounting member provides pivot means and is pivotably mounted on said driven arbor with said snagger on one side of said pivot means and said counterweight on the other side of said pivot means.

25. A continuous wire winding machine in accordance with claim 19, and wherein said traversing means comprises sheave means over which the running wire is trained for traversing supply to the core of the reel to be wound, a lead screw fixedly mounted on said machine frame for traversing said idler sheaves along the length of the core, an X-Y table comprising bearings and tracks on which said bearings move, drive means for said lead screw, and means fixedly mounting said drive means on said machine frame, and means for shifting the idler sheaves between a first position in which one of said driven arbors is to be driven and a second position in which the other of said driven arbors is to be driven.

26. A continuous wire winding machine in accordance with claim 19, and wherein said robotic arm transfer means comprises a pair of opposite grippers for concurrently gripping an empty reel on said conveyor and a wound reel between a pair of said arbor means, wherein each said driven arbor mounts a snagger, wherein said blocker and hook means include a pair of blockers, one for each driven arbor, for blocking running wire from engaging the snagger of a wound reel when the wire is to be diverted and cut, and wherein each said snagger is mounted on a counterweight snagger means pivotally mounted on a said driven arbor.

* * * * *